US007283903B2

(12) United States Patent
Merten et al.

(10) Patent No.: US 7,283,903 B2
(45) Date of Patent: Oct. 16, 2007

(54) ENABLING SYSTEM FOR AN IMPLEMENT CONTROLLER

(75) Inventors: James Gerard Merten, Dubuque, IA (US); Robert Joseph Hachmann, Peosta, IA (US); Bruce Allan Musmaker, Asbury, IA (US); Michael Gacioch, Dubuque, IA (US)

(73) Assignee: Deere & Company, Moline, IL (US)

( * ) Notice: Subject to any disclaimer, the term of this patent is extended or adjusted under 35 U.S.C. 154(b) by 243 days.

(21) Appl. No.: 10/816,109

(22) Filed: Apr. 1, 2004

(65) Prior Publication Data

US 2005/0222733 A1 Oct. 6, 2005

(51) Int. Cl.
*G06F 7/70* (2006.01)

(52) U.S. Cl. ..... 701/50; 701/29; 701/33; 172/4.5; 172/9; 180/330; 307/10.6

(58) Field of Classification Search ..... 701/1, 701/50, 29, 33; 414/699–700; 180/330–331, 180/270, 273, 89.13; 172/2, 4, 4.5, 6–10, 172/431, 434, 436; 307/9.1, 10.1, 10.6
See application file for complete search history.

(56) References Cited

U.S. PATENT DOCUMENTS 4,699,561 A 10/1987 Tee
4,934,462 A 6/1990 Tatara et al. ..... 172/2
5,092,408 A 3/1992 Tatara et al. ..... 172/2
6,041,867 A * 3/2000 Orbach et al. ..... 172/2
6,112,839 A * 9/2000 Ostler et al. ..... 180/53.4
6,135,230 A 10/2000 Schenck et al. ..... 180/273
6,226,902 B1 5/2001 Heyne ..... 37/348
6,430,850 B1 8/2002 VanDerZyl et al.
6,555,932 B1 * 4/2003 Albrecht ..... 307/9.1
6,643,577 B1 * 11/2003 Padgett et al. ..... 701/50
6,694,240 B1 2/2004 Swick et al.
6,711,839 B1 * 3/2004 Kawamura et al. ..... 37/466
6,980,895 B2 * 12/2005 Paice et al. ..... 701/50

* cited by examiner

*Primary Examiner*—Gertrude A. Jeanglaude

(57) ABSTRACT

A system for reliably enabling an implement controller for a work vehicle having a swivel seat with at least two angular positions. The system includes an implement controller for controlling a work implement, seat position detector for determining the positions of the swivel seat, an ignition switch and an implement controller toggle switch. The system is capable of enabling the implement controller under ideal enablement conditions and non-ideal enablement conditions. Ideal enablement conditions exist when the implement controller toggle switch is toggled to an implement controller enabling state while the ignition switch is on and the seat is properly positioned. Non-ideal enablement conditions exit when the implement controller toggle switch is put in an implement controller enabling state in the absence of ideal enablement conditions.

42 Claims, 3 Drawing Sheets

ENABLING SYSTEM FOR AN IMPLEMENT CONTROLLER

FIELD OF THE INVENTION

The invention relates to work vehicles having multiple position swivel seats and implement controllers that are easily operated. More particularly, the invention relates to loader backhoes with easily operated implement controllers.

BACKGROUND OF THE INVENTION

Traditional control systems for backhoes have included floor mounted hydraulic levers with a sufficient resistance to movement and an adequate distance from the swivel seat to avoid inadvertent operation. Some have included rudimentary enablement conditions, e.g., an operator's presence switch that detects a weight on the vehicle seat, to activate the traditional controllers. Still others have included systems with pilot controllers that automatically enable and disable the pilot controllers in accordance with seat orientation, i.e., enablement typically requires a seat orientation in the direction of the controls to be enabled.

SUMMARY OF THE INVENTION

Many modern controllers such as, for example, pilot controllers and electro-hydraulic controllers (hereafter implement controllers) are, by their very nature, easy to manipulate and conventional enablement systems may not provide adequate assurance that the backhoe tool will be manipulated only by deliberate acts of the operator. Accentuating this problem is the fact that the controller towers on which the implement controllers are usually mounted tend to be relatively close to the seat.

The invention provides an enabling system giving greater assurance than conventional systems that the operator will manipulate the backhoe tool only in a deliberate manner. The enabling system accomplishes this by requiring the existence of enablement conditions and a deliberate act of the operator for enablement of the implement controllers. There are two types of implement controller enablement according to the invention: (1) ideal enablement; and (2) non-ideal enablement.

Ideal enablement requires the following enablement conditions: (1) the swivel seat, often associated with backhoes, is in a backhoe operating position and not in another operating position; (2) the ignition switch is in a power on state; and (3) an implement controller toggle switch is toggled to a state for implement controller enablement while ideal enablement conditions (1) and (2) exist. Thus, ideal enablement of the implement controller occurs only if the operator toggles the implement controller toggle switch to the state for implement controller enablement after and while power is on in the work vehicle and the seat is in the backhoe operating position. If, after implement controller enablement, any one of the conditions change, the implement controller is automatically disabled. The implement controller is ideally re-enabled only after the ideal enabling conditions are, once again, established.

Non-ideal enablement requires the following conditions: (1) the swivel seat is not in the backhoe operating position; (2) the ignition switch is in a power on state; and (3) the implement controller toggle switch is toggled to a state for implement controller enablement while non-ideal enablement conditions (1) and (2) are true. Thus, non-ideal enablement is, in essence, an override condition in which the implement controller toggle switch acts as an override switch. The operator is reminded that non-ideal enablement is in effect via a visual alert from a display of a monitor and/or an audible sound from a speaker of a monitor. The reminder may be a singular one time alert, a periodic alert or a constant alert.

The non-ideal enablement allows the operator to perform multiple functions when necessary. Thus, an operator may swivel his seat to the loader operating position or to a position between the backhoe operating position and the loader operating position and manipulate his shovel or move his vehicle while, at the same time, manipulating his backhoe work tool. Swiveling the seat into or out of any position disables the implement controller requiring re-enablement before control is, once again, established.

The enabling system achieves the best results when the vehicle is functioning properly but may be required during a malfunction of the vehicle. Thus, an option is provided in which an accumulator maintains backup hydraulic pressure for the backhoe functions allowing the operator to lower the backhoe instrument to the ground in a controlled fashion should the engine stop or fail.

BRIEF DESCRIPTION OF THE DRAWINGS

Embodiments of the invention will be described in detail, with references to the following figures, wherein.

DESCRIPTION OF THE ILLUSTRATED EMBODIMENT

Figure 1:
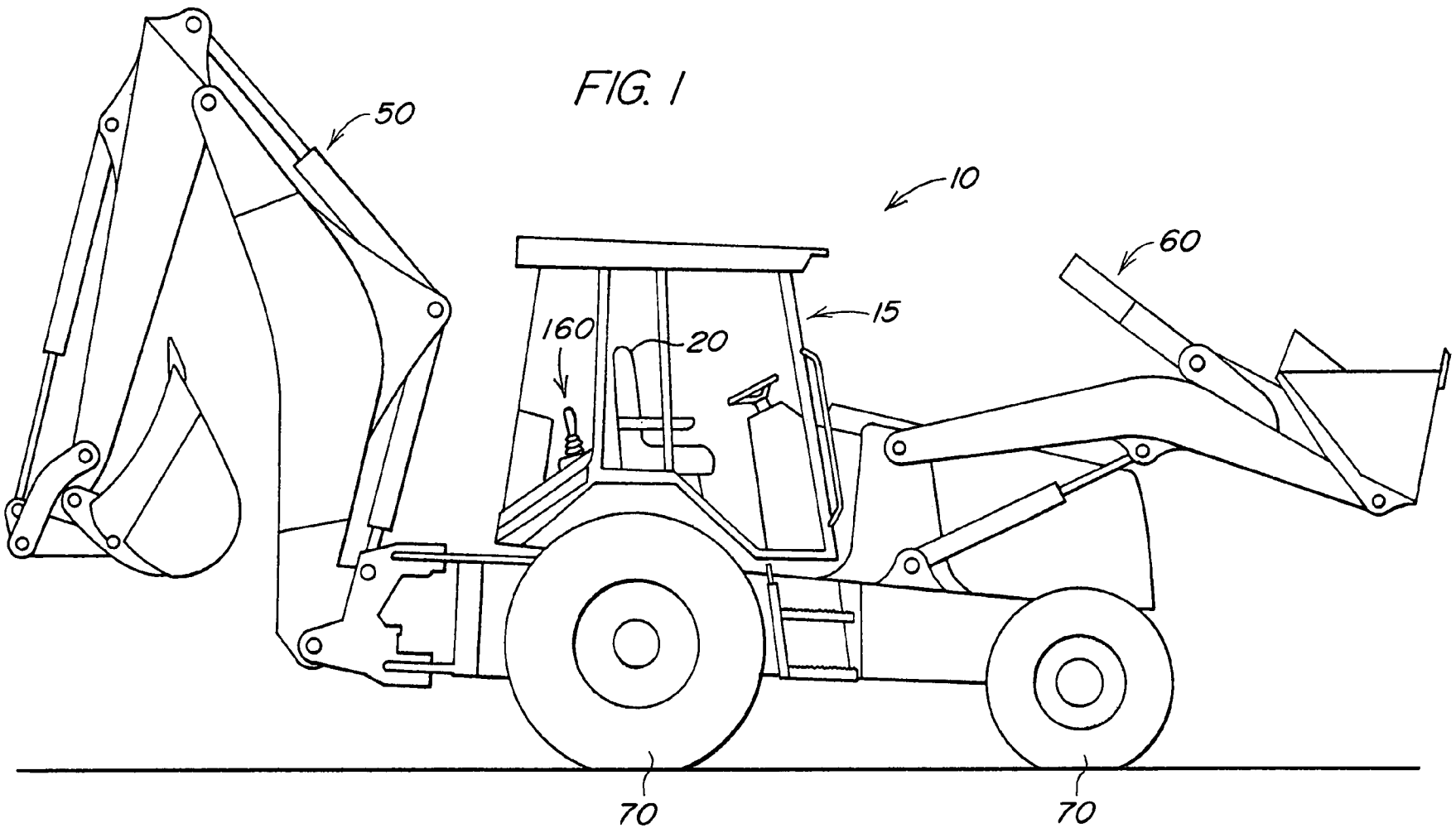
FIG. 1 is a view of a work vehicle in which the invention may be used.

FIG. 1 illustrates a work vehicle 10 in which the invention may be used. The particular work vehicle 10 shown in FIG. 1 is a loader backhoe which, typically, has dual functions. The functions of the particular work vehicle 10 illustrated are that of a backhoe and that of a loader. The work vehicle 10 includes a cab 15, a swivel seat 20, at least one implement controller 160, a backhoe portion 50 and a loader portion 60. It also includes wheels 70 as well as a propulsion system (not shown) that propels it along the ground in a manner well known in the art. The swivel seat 20 has at least two set positions, i.e., swivel angles at which it can be locked. These set positions include at least an angle in which the swivel seat 20 faces the backhoe portion 50 and an angle in which the swivel seat 20 faces the loader portion 60; they are usually 180° apart angularly as indicated in FIG. 1. The swivel seat 20 is in the backhoe or loader operating position when it is within about 15° of each of the set positions, respectively.

Figure 2:
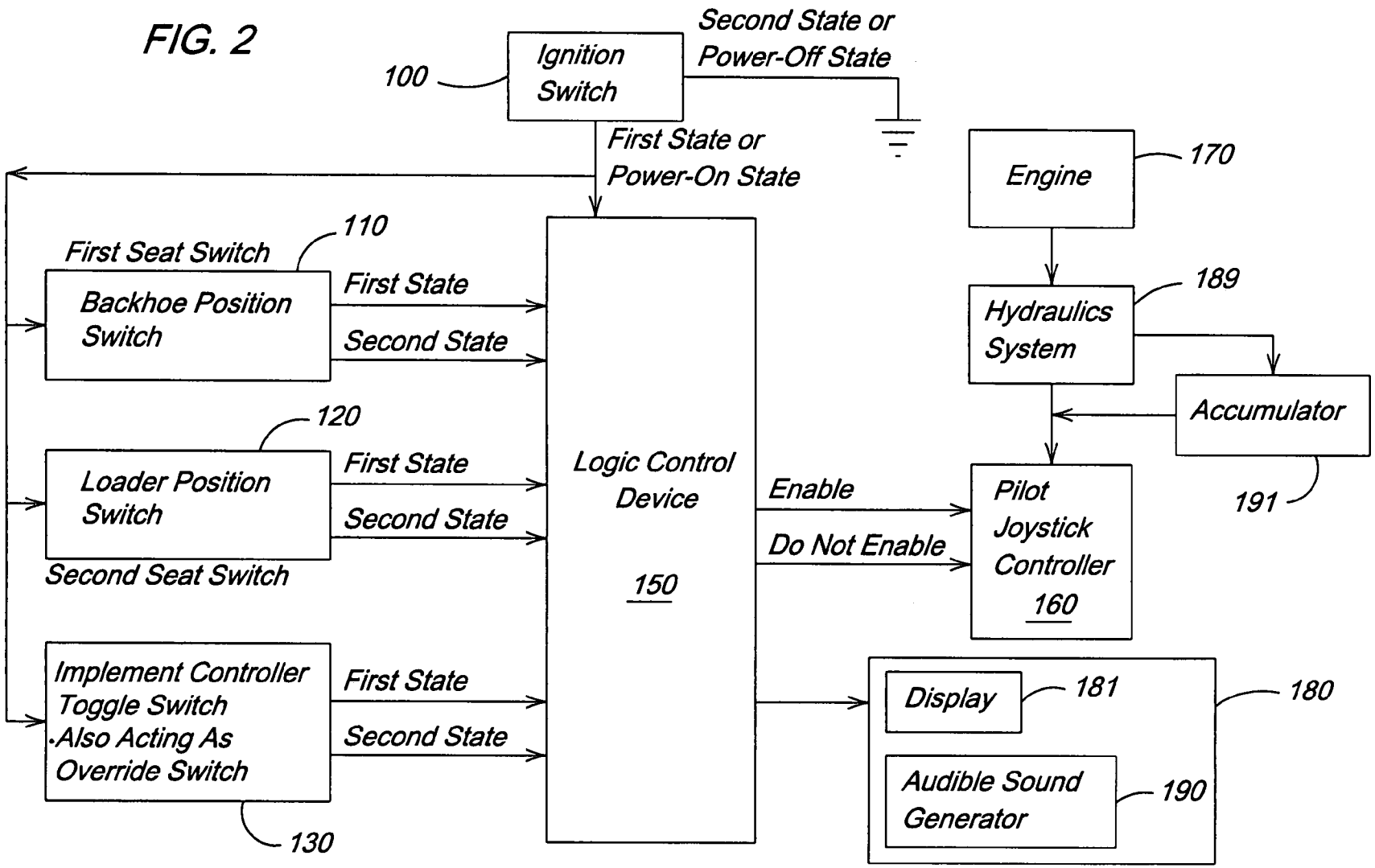
FIG. 2 is a block diagram illustrating an exemplary embodiment of the operation of the invention.

FIG. 2 is a block diagram outlining an exemplary embodiment of the invention. Included in the diagram are: an ignition switch 100; a first seat switch 110 for indicating whether or not the swivel seat 20 is in a backhoe operating position; a second seat switch 120 for indicating whether or not the swivel seat 20 is in a loader operating position; an implement controller 160; an implement controller toggle switch 130 for enabling the implement controller 160 which also serves as an override switch; and a logic control device 150. The logic control device 150 may be a conventional on board controller computer for the vehicle, a conventional hardwired switching mechanism or a conventional group of switches and relays arranged to effect the logic of the invention via methods well known to those of ordinary skill in the art.

Figure 3:
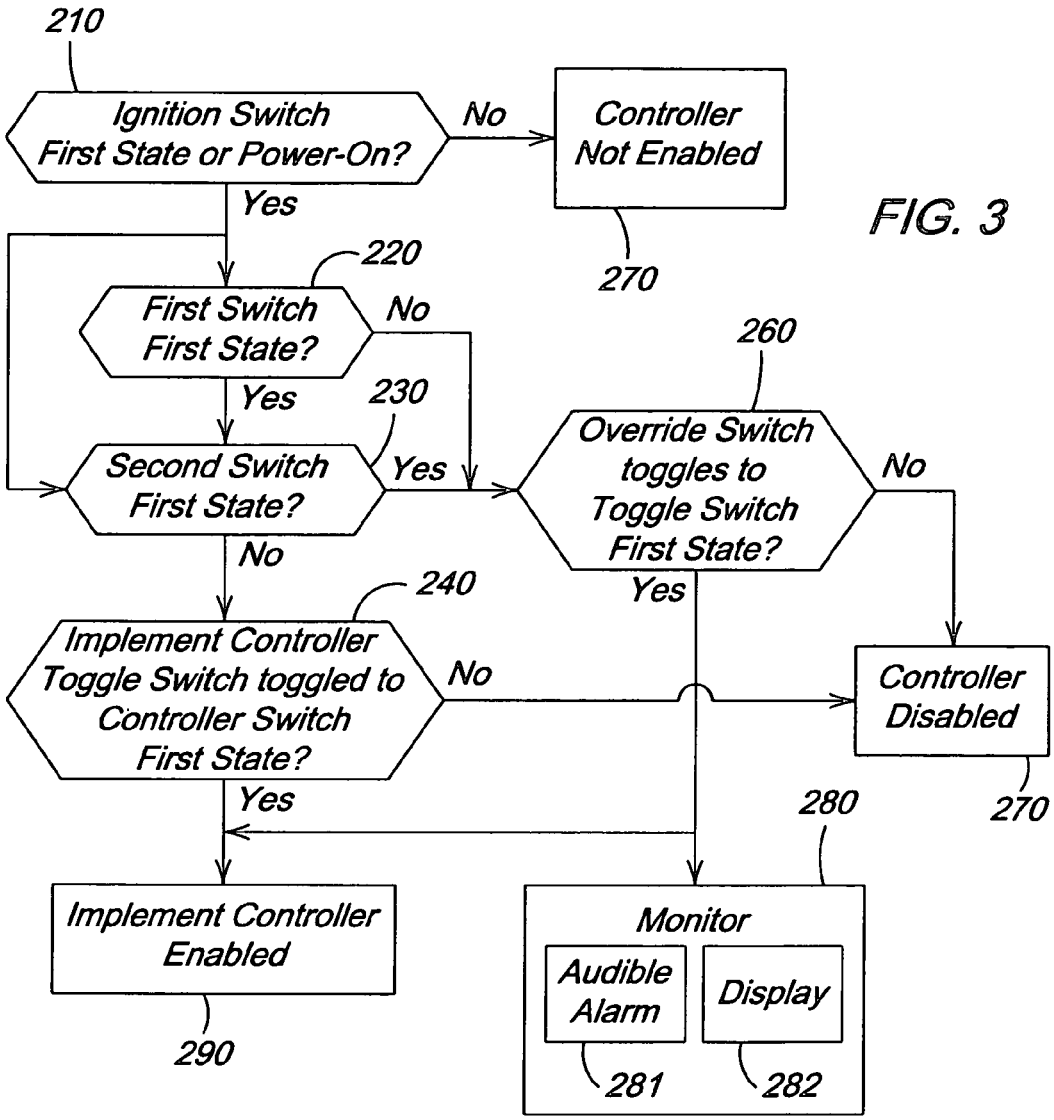
FIG. 3 is a flowchart of operating steps for the joystick enablement system.

FIG. 3 is a flowchart detailing a control loop 200 of operating steps for the invention as embodied in FIG. 2. The operating steps set forth in FIG. 3 may be incorporated into the hardware and/or software programming of the logic control device 150 via techniques well known to those of ordinary skill in the art. As shown in FIG. 2 as well as in FIG. 3, the entire process begins with step 210, i.e., a power-on state for the ignition switch 100 as this is required to initiate a flow of energy necessary for activating all other switches. As illustrated, if the ignition switch 100 is in a power-off state in step 210, the process ends immediately at step 270 and the pilot joystick controller 160 is not enabled. Once the ignition switch 100 is in a power-on state, the state of the first seat switch 110 is checked at step 220. If the first seat switch 110 is in a first seat switch first state indicating the swivel seat 20 is in the backhoe operating position, the process moves to step 230 to determine the state of the second seat switch 120. If the second seat switch 120 is not in the second seat switch first state then the process moves to step 240. If, at step 240, the implement controller toggle switch 130 is then toggled to a toggle switch first state, the implement controller 160 is ideally enabled implement controller.

If, at step 220, the first seat switch 110 is not in a first seat switch first state or, at step 230, the second switch is in a second seat switch first state, the process branches to step 270 and the implement controller is not enabled unless the implement controller toggle switch 130 is toggled to the toggle switch first state at step 260. If, under these conditions, the implement controller toggle switch 140 is used as the override switch and toggled to the controller switch first state the process moves to step 250, where the implement controller is non-ideally enabled, and branches to 280 where the operator is informed of a non-ideal enablement via the monitor 180 through at least one of the display 181 and the audible sound generator 190.

Figure 4:
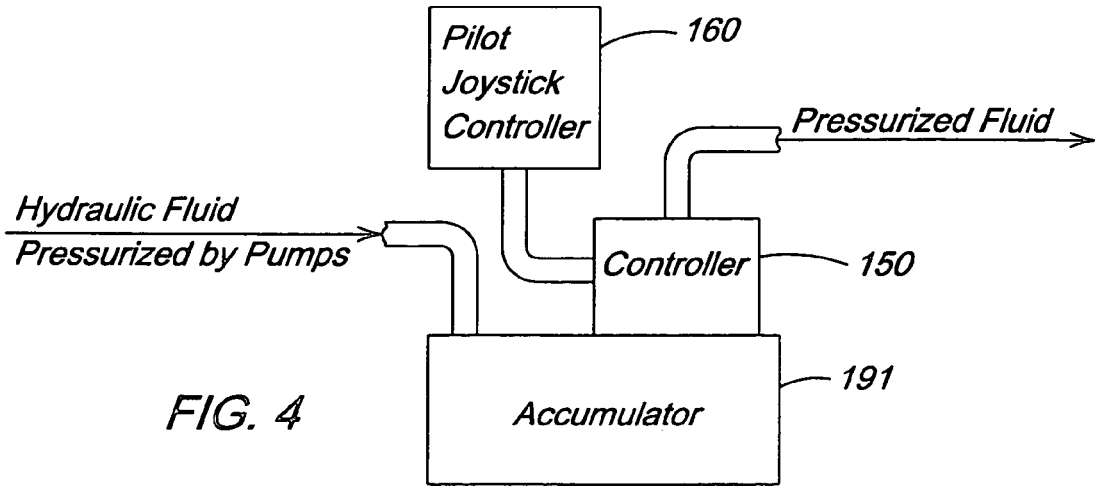
FIG. 4 illustrates an emergency accumulator for a backhoe system for controlling the lowering of the backhoe work tool upon inadvertent engine failure.

FIG. 4 illustrates an accumulator 191 that increases the reliability of the enabling system. The accumulator 191 functions as a failsafe mechanism in the event of a catastrophic loss of hydraulic pressure provided by the engine (not shown) and hydraulic pumps (not shown). Such a failure could occur as a result of, for example, engine failure, hydraulic line failure, hydraulic pump failure, etc. Should the supplied hydraulic pressure fail, the accumulator 191 serves as a temporary pressure sustainer and allows the operator to use the implement controller 160 to appropriately return the work tool, which is typically a backhoe, to a convenient position such as a stow position.

Having described the illustrated embodiment, it will become apparent that various modifications can be made without departing from the scope of the invention as defined in the accompanying claims. For example, the means for seat position detection has, thus far, included two seat switches, i.e., the first seat switch 110 and the second seat switch 120. However, comparable results could be obtained with the use of a greater number of seat switches or a single seat switch.

The invention claimed is:

1. An implement controller enabling system for a work vehicle, the work vehicle including a swivel seat having a first position and a second position, and an engine, the implement controller enabling system comprising:

an implement controller capable of being enabled and disabled;

a first seat switch having a first seat switch first state and a first seat switch second state, the first switch entering the first seat switch first state when the swivel seat is substantially in the first position;

a second seat switch having a second seat switch first state and a second seat switch second state, the second seat switch entering the second seat switch first state when the swivel seat is substantially in the second position;

an ignition switch having a power-on state and a power-off state; and an implement controller toggle switch capable of being toggled to an implement controller switch first state and a implement controller switch second state, the implement controller being enabled when ideal enablement conditions exist, the ideal enablement conditions existing only when the ignition switch is in the power-on state, the first seat switch is in the first seat switch first state, the second seat switch is in the second seat switch second state and the implement controller toggle switch is toggled to the implement controller switch first state, the implement controller toggle switch being toggled to the implement controller switch first state when the ignition switch is in the power-on state and the first seat switch is in the first seat switch first state.

2. The implement controller enabling system of claim 1, wherein at least one of the first seat switch, second seat switch, ignition switch and implement controller toggle switch is an electrical switch.

3. The implement controller enabling system of claim 1, wherein the implement controller that is enabled becomes disabled when one of the first seat switch, second seat switch, ignition switch and implement controller toggle switch undergoes a change of state.

4. The implement controller enabling system of claim 1, further comprising a system override switch for enabling the implement controller under non-ideal enablement conditions, the system override switch having an override switch first state and an override switch second state, the non-ideal enablement conditions existing when the system override switch is put in the override switch first state while the ignition switch is in the power-on state and the ideal enablement conditions do not exist, the implement controller being enabled when the override switch is toggled to the override switch first state in an absence of the ideal enablement conditions.

5. The implement controller enabling system of claim 4, further comprising a monitor, the monitor having an audible signal generator, the audible signal generator emitting an audible signal when the implement controller is enabled in the absence of the ideal enablement conditions.

6. The implement controller enabling system of claim 4, further comprising a monitor, the monitor displaying a message indicating that an override condition exists when the implement controller is enabled in the absence of the ideal enablement conditions.

7. The implement controller enabling system of claim 2, wherein the at least one of the first seat switch, second seat switch, ignition switch and implement controller toggle switch is closed when it is in a controller switch first state and open when it is in a second state.

8. The implement controller enabling system of claim 2, wherein the at least one of the first seat switch, second seat switch, ignition switch and implement controller toggle switch is open when it is in a first state and closed when it is in a second state.

9. The implement controller enabling system of claim 5, wherein the audible signal generator emits an audible signal when the first seat switch is in the first seat switch first state and the second seat switch is in the second seat switch first state.

10. The implement controller enabling system of claim 6, wherein the monitor displays a message indicating a non-ideal enablement when the first seat switch is in the first seat switch first state and the second seat switch is in the second seat switch first state.

11. The implement controller enabling system of claim 4, wherein the override switch comprises the implement controller toggle switch.

12. The implement controller enabling system of claim 1, wherein the implement controller is a joystick.

13. An implement controller enabling system for a work vehicle, the work vehicle including a swivel seat having a first position and a second position; and an engine, the implement controller enabling system comprising:

an implement controller capable of being enabled and disabled;

a first seat switch having a first seat switch first state and a first seat switch second state, the first seat switch entering the first seat switch first state when the swivel seat is substantially in the first position;

a second seat switch having a second seat switch first state and a second seat switch second state, the second seat switch entering the second seat switch first state when the swivel seat is substantially in the second position;

an ignition switch having a power-on state and a power-off state;

an implement controller toggle switch capable of being toggled to a controller switch first state and a controller switch second state; and a logic control device for detecting the states of each of the first, second, ignition and implement controller toggle switches and enabling or disabling the implement controller based on the states detected, the logic control device enabling the implement controller when an ideal enablement condition exists, the ideal enablement condition existing only when the logic control device contiguously detects the power-on state, the first seat switch first state, the second seat switch second state and the controller switch first state, the implement controller toggle switch being toggled to the controller switch first state while the ignition switch is in the power-on state and the first seat switch is in the first seat switch first state.

14. The implement controller enabling system of claim 13, wherein at least one of the first seat switch, second seat switch, ignition switch and implement controller toggle switch is an electrical switch.

15. The implement controller enabling system of claim 13, wherein the logic control device disables an enabled implement controller when one of the first seat switch, second seat switch, ignition switch and implement controller toggle switch undergoes a change of state.

16. The implement controller enabling system of claim 13, further comprising a system override switch for enabling the implement controller under non-ideal enablement conditions, the system override switch having an override switch first state and an override switch second state, the non-ideal enablement conditions existing when the system override switch is put in the override switch first state while the ignition switch is in the power-on state and the ideal enablement conditions do not exist, the logic control device enabling the implement controller under non-ideal enablement conditions.

17. The implement controller enabling system of claim 16, further comprising a monitor having an audible signal generator, the logic control device causing the audible signal generator to emit an audible signal when the implement controller is enabled in an absence of the ideal enablement conditions.

18. The implement controller enabling system of claim 16, further comprising a monitor, the logic control device causing the monitor to display a message indicating that an override condition exists when the implement controller is enabled in an absence of the ideal enablement conditions.

19. The implement controller enabling system of claim 14, wherein the at least one of the first seat switch, second seat switch, ignition switch and implement controller toggle switch is closed when it is in a first state and open when it is in a second state.

20. The implement controller enabling system of claim 14, wherein the at least one of the first seat switch, second seat switch, ignition switch and implement controller toggle switch is open when it is in a first state and closed when it is in a second state.

21. The implement controller enabling system of claim 17, wherein the logic control device causes the audible signal generator to emit an audible signal when the first seat switch is in the first seat switch first state and the second seat switch is in the second seat switch first state.

22. The implement controller enabling system of claim 18, wherein the logic control device causes the monitor to display a message indicating a system fault when the first seat switch is in the first seat switch first state and the second seat switch is in the second seat switch first state.

23. The implement controller enabling system of claim 16, wherein the override switch comprises the implement controller toggle switch.

24. The implement controller enabling system of claim 13, wherein the implement controller is a joystick.

25. A work vehicle comprising:

a swivel seat having a first position and a second position and an implement controller enabling system, the implement controller enabling system comprising:

an implement controller capable of being enabled and disabled;

a first seat switch having a first seat switch first state and a first seat switch second state, the first seat switch entering the first seat switch first state when the swivel seat is substantially in the first position;

a second seat switch having a second seat switch first state and a second seat switch second state, the second seat switch entering the second seat switch first state when the swivel seat is substantially in the second position;

an ignition switch having an ignition switch first state and an ignition switch second state;

an implement controller toggle switch capable of being toggled to a controller switch first state and a controller switch second state; and a logic control device for detecting the states of each of the first seat switch, second seat switch, ignition switch and implement controller toggle switch and enabling or disabling the implement controller based on the states detected, the logic control device enabling the implement controller when ideal enablement conditions exist, the ideal enablement conditions existing only when the logic control device contiguously detects the ignition switch first state, the first seat switch first state, the second seat switch second state and the controller switch first state, the implement controller toggle switch being toggled to the controller switch first state while the ignition switch is in the ignition switch first state, the first seat switch is in the first seat switch first state and the second seat switch is in the second seat switch second state.

26. The work vehicle of claim 25, wherein at least one of the first seat switch, second seat switch, ignition switch and implement controller toggle switch is an electrical switch.

27. The work vehicle of claim 25, wherein the logic control device disables an enabled implement controller when one of the first seat switch, second seat switch, ignition switch and implement controller toggle switch undergoes a change of state.

28. The work vehicle of claim 25, further comprising a system override switch for enabling the implement controller under non-ideal enablement conditions, the system override switch having an override switch first state and an override switch second state, the non-ideal enablement conditions existing when the system override switch is put in the override switch first state while the ignition switch is in the ignition switch first state and the ideal enablement conditions do not exist, the logic control device enabling the implement controller under the non-ideal enablement conditions.

29. The work vehicle of claim 28, further comprising an audible signal generator, the logic control device causing the audible signal generator to emit an audible signal when the implement controller is enabled in an absence of the ideal enablement conditions.

30. The work vehicle of claim 28, further comprising a monitor, the logic control device causing the monitor to display a message indicating that an override condition exists when the implement controller is enabled in an absence of the ideal enablement conditions.

31. The work vehicle of claim 26, wherein the at least one of the first seat switch, second seat switch, ignition switch and implement controller toggle switch is closed when it is in a first state and open when it is in a second state.

32. The work vehicle of claim 26, wherein the at least one of the first seat switch, second seat switch, ignition switch and implement controller toggle switch is open when it is in a first state and closed when it is in a second state.

33. The work vehicle of claim 29, wherein the logic control device causes the audible signal generator to emit an audible signal when the implement controller toggle switch is toggled to the controller switch first state while the first seat switch is in the first seat switch first state and the second seat switch is in the second seat switch first state.

34. The work vehicle of claim 30, wherein the logic control device causes the monitor to display a message indicating a non-ideal enablement when the implement controller toggle switch is toggled to the controller switch first state while the first seat switch is in the first seat switch first state and the second seat switch is in the second seat switch first state.

35. The implement controller enabling system of claim 28, wherein the override switch comprises the implement controller toggle switch.

36. The work vehicle of claim 25, wherein the implement controller is a joystick.

37. An implement controller enabling system for a work vehicle, the work vehicle including a swivel seat having a first position and a second position, and an engine, the implement controller enabling system comprising:

an implement controller capable of being enabled and disabled;

at least one seat switch having at least one state indicating the swivel seat is in one of the first position, the second position and a third position, the third position being between the first position and the second position;

an ignition switch having an ignition switch first state and an ignition switch second state; and an implement controller toggle switch capable of being toggled to a controller switch first state and a controller switch second state, the implement controller being enabled when ideal enablement conditions exist, the ideal enablement conditions existing only when the ignition switch is in the ignition switch first state, the at least one seat switch indicates that the seat is substantially in the first position and not in the second position or the third position, and the implement controller toggle switch is toggled to the controller switch first state, the implement controller toggle switch being toggled to the controller switch first state while the ignition switch is in the ignition switch first state and the at least one seat switch is indicating that the seat is substantially in the first position and not in the second position or the third position.

38. The implement controller enabling system of claim 37, wherein the implement controller is enabled when non-ideal enablement conditions exist, the non-ideal enablement conditions existing when the implement controller toggle switch is toggled to the controller switch first state while the ignition switch is in the ignition switch first state and the at least one seat switch indicates the swivel seat is not in the first position.

39. The implement controller enabling system of claim 38, wherein the implement controller is enabled when non-ideal enablement conditions exist, the non-ideal enablement conditions existing when the implement controller toggle switch is toggled to the controller switch first state while the ignition switch is in the ignition switch first state and the at least one seat switch indicates the swivel seat is in one of the second position and the third position.

40. The implement controller enabling system of claim 38, wherein the at least one seat switch comprises:

a first seat switch having a first seat switch first state and a first seat switch second state, the first seat switch entering the first seat switch first state when the swivel seat is substantially in the first position; and a second seat switch having a second seat switch first state and a second seat switch second state, the second seat switch entering the second seat switch second state when the seat switch is substantially in the second position.

41. The implement controller enabling system of claim 40, wherein the swivel seat is substantially in the first position when it is angularly within 15° of a backhoe operating position.

42. The implement controller enabling system of claim 40, wherein the swivel seat is substantially in the second position when it is angularly within 15° of the a loader operating position.

* * * * *